US007589291B2

(12) United States Patent
Saarinen et al.

(10) Patent No.: US 7,589,291 B2
(45) Date of Patent: Sep. 15, 2009

(54) MOUNTING ACCESSORY FOR THE COVER PLATE OF A HANDLE

(75) Inventors: Jarmo Saarinen, Lempäälä (FI); Pauli Hernesniemi, Lempäälä (FI)

(73) Assignee: Abloy OY, Joensuu (FI)

( * ) Notice: Subject to any disclaimer, the term of this patent is extended or adjusted under 35 U.S.C. 154(b) by 314 days.

(21) Appl. No.: 11/608,319

(22) Filed: Dec. 8, 2006

(65) Prior Publication Data

US 2007/0130711 A1 Jun. 14, 2007

(30) Foreign Application Priority Data

Dec. 9, 2005 (FI) ..... 20055656

(51) Int. Cl.
*H01H 21/04* (2006.01)

(52) U.S. Cl. ..... 200/332.2; 200/293; 200/61.62

(58) Field of Classification Search ... 200/61.62–61.68, 200/61.78, 61.81, 61.87, 293, 293.1, 294, 200/295, 330–333; 174/59–61, 520, 135; 70/57, 237, 257, 258

See application file for complete search history.

(56) References Cited

U.S. PATENT DOCUMENTS

| | | | | |
|---|---|---|---|---|
| 3,809,798 | A * | 5/1974 | Simon | 174/59 |
| 3,874,282 | A * | 4/1975 | Oouchi | 200/43.08 |
| 3,904,843 | A * | 9/1975 | Kendechy | 200/332 |
| 4,181,827 | A * | 1/1980 | Diepeveen | 200/6 A |
| 4,250,366 | A * | 2/1981 | Erickson et al. | 200/332.2 |
| 4,262,180 | A * | 4/1981 | Walter | 200/43.07 |
| 4,614,848 | A * | 9/1986 | Schulte et al. | 200/61.85 |
| 2003/0173200 | A1 * | 9/2003 | Hsu | 200/334 |

FOREIGN PATENT DOCUMENTS

WO 2005066440 7/2005

* cited by examiner

*Primary Examiner*—Elvin G Enad
*Assistant Examiner*—Marina Fishman
(74) *Attorney, Agent, or Firm*—Smith-Hill & Bedell, P.C.

(57) ABSTRACT

A mounting accessory for installation behind the cover plate of a handle to mount a switch device behind the cover plate includes a body having mounting formations using which the switch device can be fastened to the mounting accessory and a cable clamp for a wire attached to the switch device. The mounting accessory is formed with an installation hole for fastening the mounting accessory to the cover plate using a screw.

12 Claims, 2 Drawing Sheets

MOUNTING ACCESSORY FOR THE COVER PLATE OF A HANDLE

CROSS-REFERENCE TO RELATED APPLICATION

This application claims priority under 35 USC 119 of Finnish Patent Application No. 20055656 filed Dec. 9, 2005.

BACKGROUND OF THE INVENTION

1. Field of Technology

The present invention relates to a mounting accessory for the cover plate of a handle.

2. Prior Art

The primary purpose of the cover plate for handles such as door handles is to cover the installation opening for the spindle of the handle. The cover plate creates a clean appearance and protects the lock connected to the spindle from impurities in the environment. The cover plate is installed against a mounting base such as a door. It is also known that various elements associated with the operation of the spindle are installed behind the cover plate, such as a spring to bias the handle to a horizontal position.

It is also known that a switch can be installed in connection with the spindle in order to indicate the position of the spindle. The switch is connected to conductors through which information regarding the switch position can be transmitted forward. Information regarding the switch position is required, for example, when exit without alarm is allowed under normal circumstances but an alarm is triggered under abnormal circumstances.

The space remaining behind a mounted cover plate is small so the installation of elements to be placed there requires precision. Installation is often carried out at the factory but retrofitting is also possible. The object of the invention is to provide a solution to facilitate the installation of a switch to be installed behind a cover plate.

SUMMARY OF THE INVENTION

In accordance with the invention there is provided a mounting accessory for installation behind the cover plate of a handle to mount a switch device behind the cover plate, wherein the mounting accessory comprises a body having mounting formations using which the switch device can be fastened to the mounting accessory, and a cable clamp for a wire attached to the switch device, and wherein the mounting accessory is formed with an installation hole for fastening the mounting accessory to the cover plate using a screw.

A mounting accessory embodying the invention may be used for fastening a switch placed behind a cover plate and for providing a cable clamp for the wire going to the switch. This makes installation easier and faster compared to prior art solutions.

In a preferred embodiment of the invention, the cable clamp is an extension of the body of the mounting accessory and includes a flexible arm part and an end with a hole. The extension can be bent so that the hole in the end of the extension can be positioned over the installation hole in order to grip the wire going to the switch using the bent arm part utilizing the screw.

BRIEF DESCRIPTION OF THE DRAWINGS

In the following, the invention is described in more detail by reference to the enclosed drawings, where.

DETAILED DESCRIPTION

Figure 1:
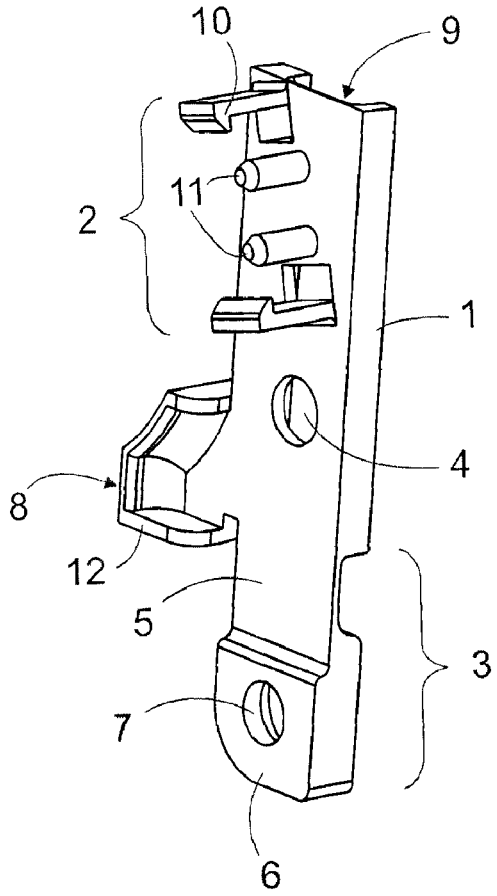
FIG. 1 illustrates a mounting accessory embodying the present invention viewed from the front.
Figure 3:
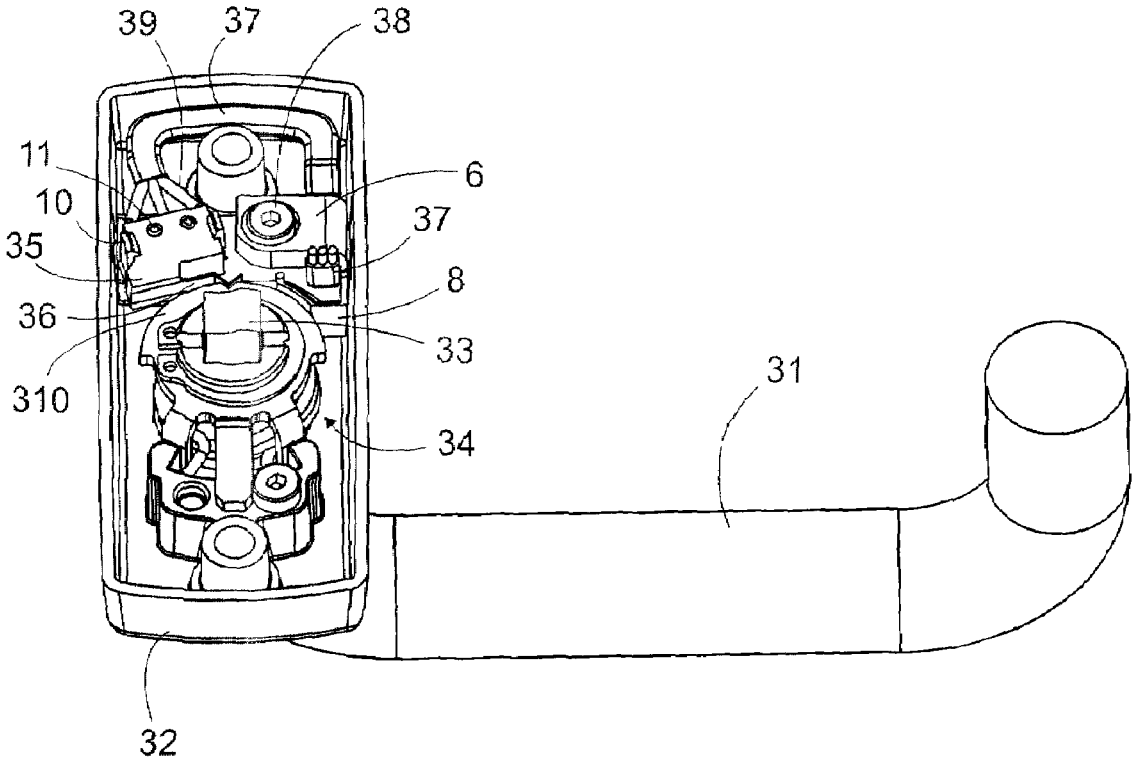
FIG. 3 illustrates a mounting example of a mounting accessory embodying the invention.

FIG. 1 illustrates a mounting accessory embodying the invention. The illustrated mounting accessory comprises a body 1 that includes mounting formations 2 using which a switch 35 (FIG. 3) to be mounted behind the cover plate can be fastened to the mounting accessory. The body 1 is formed with an installation hole 4 for fastening the mounting accessory to the cover plate using a screw 38 (FIG. 3). The mounting accessory also comprises a cable clamp 3 for the wire going to the switch.

In the embodiment of FIG. 1, the cable clamp 3 is an extension of the body 1 and comprises a flexible arm part or hinge 5 and an end 6 with a hole 7. The extension can be bent at the hinge 5 so that the hole 7 in the end 6 of the extension can be placed over (aligned with) the installation hole 4 and the screw 38 (FIG. 3) that is used to fasten the mounting accessory to the cover plate passes through both holes 4, 7 and serves to clamp the end 6 against the body 1. The wire going to the switch is gripped in the bent arm part 5. The flexible arm part 5 can be, for example, a strip of material thinner than the body 1 and the end 6 of the cable clamp. The structure of the cable clamp may also be different from that illustrated in FIG. 1. For example, the arm of the cable clamp may be a structure made into a bent form, the end of which can be tightened towards the body of the mounting accessory using a screw.

It is preferred that the body has a guiding formation 8 for guiding the wire in the desired direction. The purpose of the guiding formation is to prevent the wire from accidentally getting stuck in the elements installed in connection with the spindle, since such a stuck wire could actually prevent the movement of the handle. The preferred location for the guiding formation 8 is beside the cable clamp 3 on the side from which the wire to the switch is intended to be fed away from the cover plate. The guiding formation shown in FIG. 1 has a raised edge 12 but the structure of the guiding formation can be different from this. For example, the guiding formation may have a sloping ascending surface.

Figure 2:
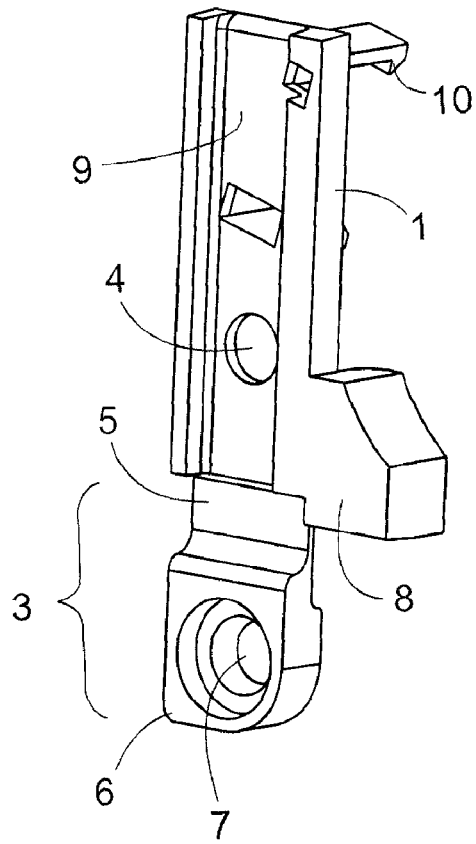
FIG. 2 illustrates the mounting accessory of FIG. 1 viewed from the back.

FIG. 2 shows the lower surface of the body 1 of the embodiment illustrated in FIG. 1, which can be mounted against the cover plate. It has a mounting groove 9 for mounting on top of a potential mounting protrusion on the cover plate. Thus the mounting groove facilitates the installation of the mounting accessory.

The mounting formations 2 of the mounting accessory are claws 10. The claws ensure that the switch stays in place. The mounting formations may also include dowel formations 11 that can be placed into holes in the switch.

FIG. 3 shows the mounting accessory when installed behind a cover plate 32 that comprises a generally flat member having a peripheral flange that engages the flat mounting surface of the door, whereby the interior surface of the generally flat member is in spaced, generally parallel, confronting relationship with the flat mounting surface of the door. In FIG. 3 the cover plate is illustrated as viewed from behind, that is, from the side that is towards the mounting surface. The mounting accessory is fastened to the cover plate using the screw 38. The handle 31 is connected to the spindle 33 installed through the cover plate 32. The spindle is only partially shown in FIG. 3. Elements 34 are installed in connection with the spindle and include, for example, a spring for biasing the handle towards the desired resting position. The resting position refers to the position of the handle when it is not depressed. The elements 34 also include a plate 310 with a slot. The plate 310 turns when the spindle 33 is turned. The plate is utilized when it is desired to know the position of the spindle and the handle.

The switch 35 is installed on the mounting formations 10, 11 of the mounting accessory. The switch comprises a lever 36 that rests against the plate 310. The lever 36 has a formation that settles into the slot in the plate 30 when the handle is in the desired resting position. Turning the handle will also turn the plate 310, making the slot move and deflecting the lever 36 of the switch away from the slot. The rising movement of the lever 36 causes a switching action in the switch, within the electric circuit of the conductors 39 connected to the switch. Correspondingly, when the handle returns to the resting position and the lever 36 settles back into the slot in the plate 310, this causes another switching action when the slot moves to the position of the lever formation.

The conductors 39 connected to the switch form a cable 37 that may have a common sheathing. Clamping for the cable 37 is provided by bending the cable clamp on the mounting accessory to position its end 6 over the installation hole 4 and the cable 37 is then gripped by the bent arm part 5. The bent arm part 5 forms a fastening surface between the mounting accessory and the cable when the end 6 of the cable clamp is tightened towards the body 1 of the mounting accessory using the screw 38.

The guiding formation 8 of the mounting accessory guides the cable 37 so that it cannot accidentally become stuck between the plate 310 and the peripheral flange of the cover plate 32. FIG. 3 shows the cable 37 bent upwards (towards the surface of the door) in an exaggerated manner in order to make the details clearer.

The material of the mounting accessory is plastic, rubber or metal suitable for the purpose. It is easier to install the switch when the fastening of the switch to the cover plate and the clamping of the cable to the switch can be done using one screw. Retrofitting in particular is easier.

It is evident from the above that the invention is not limited to the embodiments described in this text but can be implemented in many other different embodiments within the scope of the inventive idea.

The invention claimed is:

1. In combination, a door handle cover plate for attachment to a substantially flat door surface in an orientation in which an interior surface of the cover plate confronts said substantially flat door surface, a mounting accessory for installation behind the cover plate to mount a switch device behind the cover plate, the mounting accessory comprising a body having mounting formations using which the switch device can be fastened to the mounting accessory, and a cable clamp for a wire attached to the switch device, the mounting accessory being formed with an installation hole for fastening the mounting accessory to the cover plate using a screw, and a screw that passes through the installation hole and engages the cover plate for fastening the mounting accessory to the cover plate in a position in which the mounting accessory engages said interior surface.

2. A combination according to claim 1, further comprising a switch device having a wire attached thereto, and wherein the switch device is engaged by said mounting formations, whereby the switch device is fastened to the mounting accessory, and the wire is clamped by the cable clamp.

3. A combination according to claim 1, wherein the installation hole is formed in the body, the cable clamp is an extension of the body and comprises a connecting part and an end part formed with a hole, the connecting part is bendable so that the hole in the end part is aligned with the installation hole, the screw passes through both the hole in the end part and the installation hole and engages the cover plate, and the connecting part clamps the wire.

4. A combination according to claim 3, wherein the connecting part comprises a flexible hinge connecting the end part to the body.

5. A combination according to claim 2, wherein the body has a guiding formation for guiding the wire attached to the switch device in a desired direction.

6. A combination according to claim 5, wherein the guiding formation is beside the cable clamp.

7. A combination according to claim 5, wherein the guiding formation has a raised edge.

8. A combination according to claim 1, wherein the body is formed with a mounting groove for engaging a mounting protrusion on the cover plate and locating the accessory relative to the cover plate.

9. A combination according to claim 1, wherein said mounting formations comprise claws for engaging the switch device.

10. A combination according to claim 9, wherein said mounting formations comprise dowel pins for engaging holes in the switch device.

11. A combination according to claim 1, wherein the mounting accessory comprises plastic, rubber or metal.

12. A combination according to claim 1, further comprising a switch device having a wire attached thereto, a door handle attached to a spindle installed through the cover plate, and a plate mounted on the spindle for cooperating with the switch device, and wherein the switch device is engaged by said mounting formations whereby the switch device is fastened to the mounting accessory, the wire is clamped by the cable clamp, the cover plate has a peripheral flange, and the body has a guiding formation beside the cable clamp for guiding the wire to prevent the wire from becoming stuck between the plate mounted on the spindle and the peripheral flange of the cover plate.

* * * * *